United States Patent [19]

Kutrieb

[11] 4,402,664

[45] Sep. 6, 1983

[54] WASTE OIL HEATER

[76] Inventor: Wolfgang A. Kutrieb, P.O. Box 43, Rte. 2, Chetek, Wis. 54728

[21] Appl. No.: 260,823

[22] Filed: May 5, 1981

[51] Int. Cl.[3] ..... F23N 5/08

[52] U.S. Cl. ..... 431/79; 431/75; 431/340; 126/93

[58] Field of Search ..... 431/62, 63, 75, 78–80, 431/331, 333, 336–338, 340; 126/93

[56] References Cited

U.S. PATENT DOCUMENTS

| | | | |
|---|---|---|---|
| 2,306,443 | 12/1942 | Howard | 431/340 |
| 3,017,921 | 1/1962 | Stierlin | 431/63 |
| 3,017,925 | 1/1962 | Breese et al. | 431/340 |
| 4,351,316 | 9/1982 | Kroll | 431/79 |

*Primary Examiner*—Carroll B. Dority, Jr.
*Attorney, Agent, or Firm*—Clayton R. Johnson

[57] ABSTRACT

An improved waste oil heater that includes a vaporizer pan having a mounting ring, a replaceable aluminum foil piece mounted on the ring to form the bottom of the pan and a member mounted on the ring to provide threads, a tool threadingly engageable with the threaded ring member for breaking the pan loose from the bottom wall of a burner pot and removing the ring with caked residue thereon for purposes of cleaning, the burner pot having a novel arrangement of apertures for flow of air into the pot, and solid state electronic control apparatus to control the feed of waste oil that automatically compensates for variations in viscosities and caloric values found in a variety of used oils and automatically discontinues the feed in the event the flame in the burner pot goes out.

A thermocouple in the exhaust gas stream in the heater or in the stack senses the exhaust gas temperature and the control circuit operates the motor of the pump to feed oil to the pan at a fast or slow rate as determined by a room thermostat and the sensed stack gas temperature. The feeding of oil by the pump is controlled by the thermostat which alters the effect of the thermocouple by requiring a higher thermocouple voltage to produce slow feeding when the thermostat calls for more heat to be produced.

14 Claims, 7 Drawing Figures

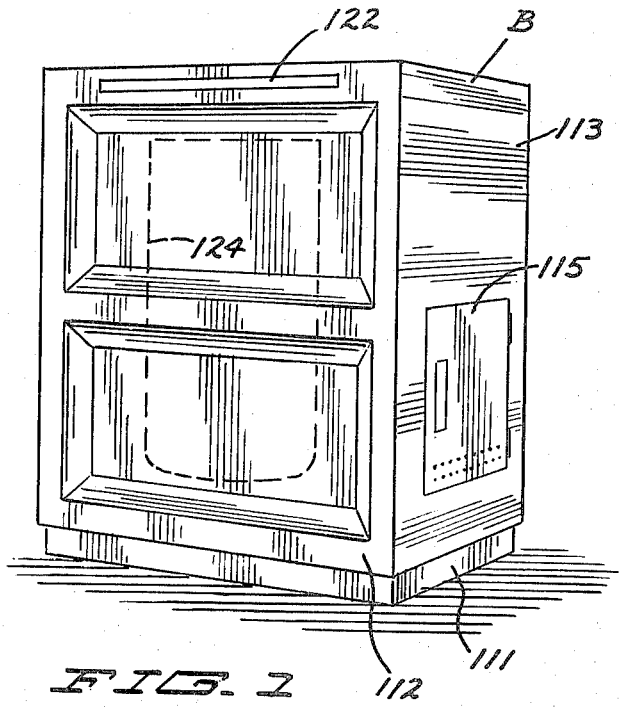
FIG. 1
FIG. 3
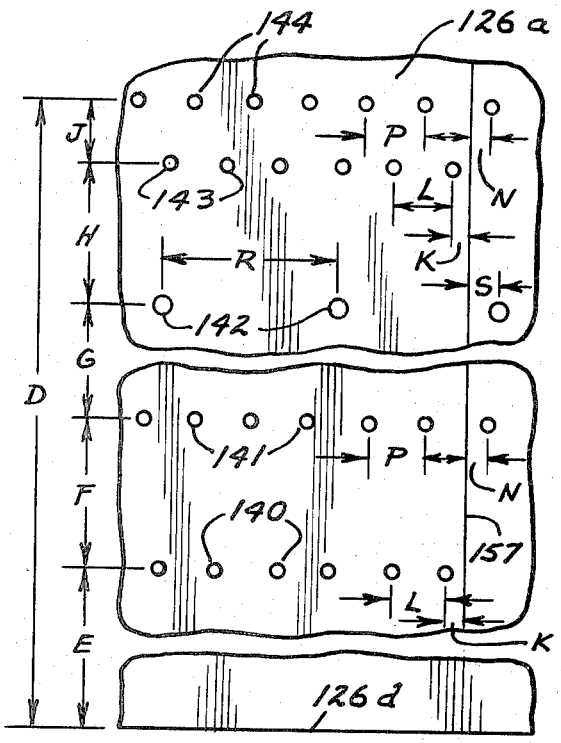
FIG. 2
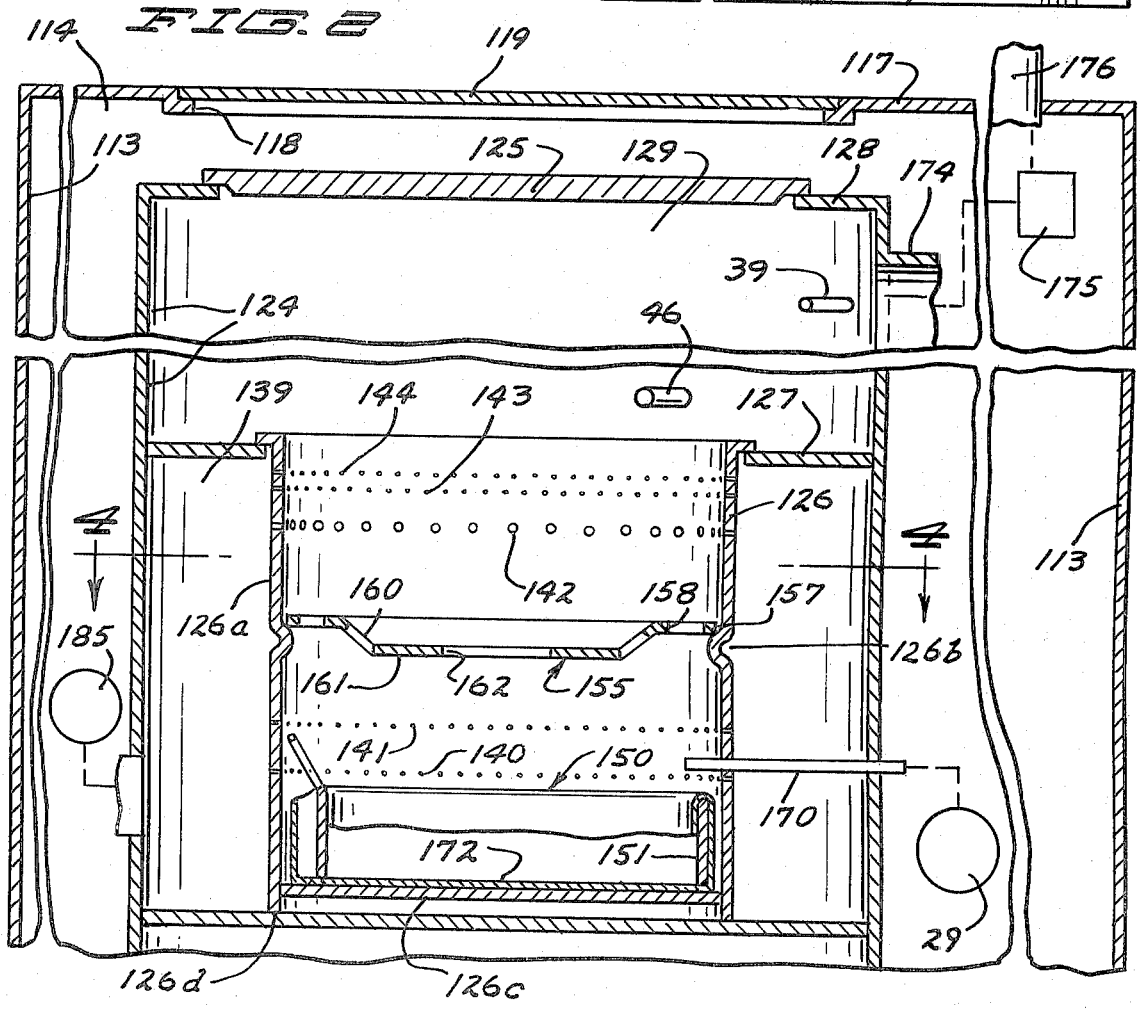

FIG. 4
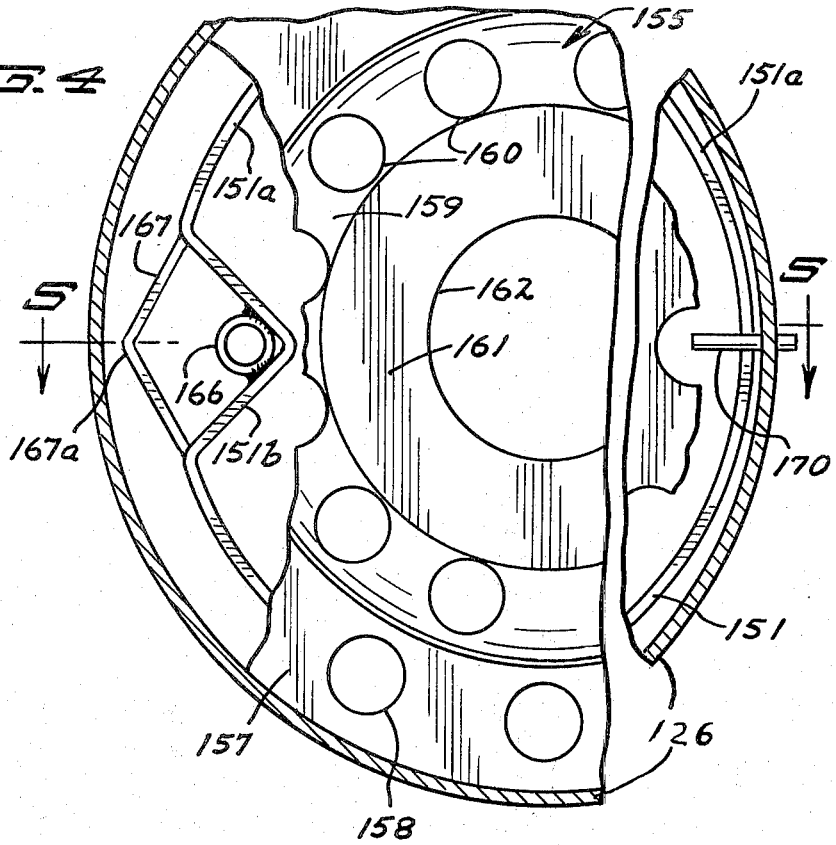
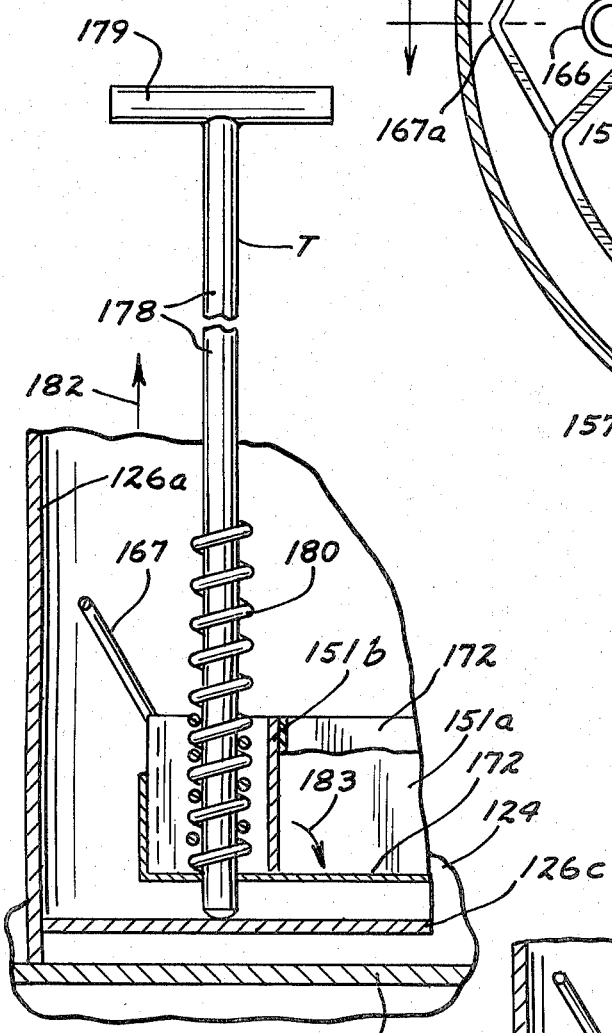
FIG. 6
FIG. 5
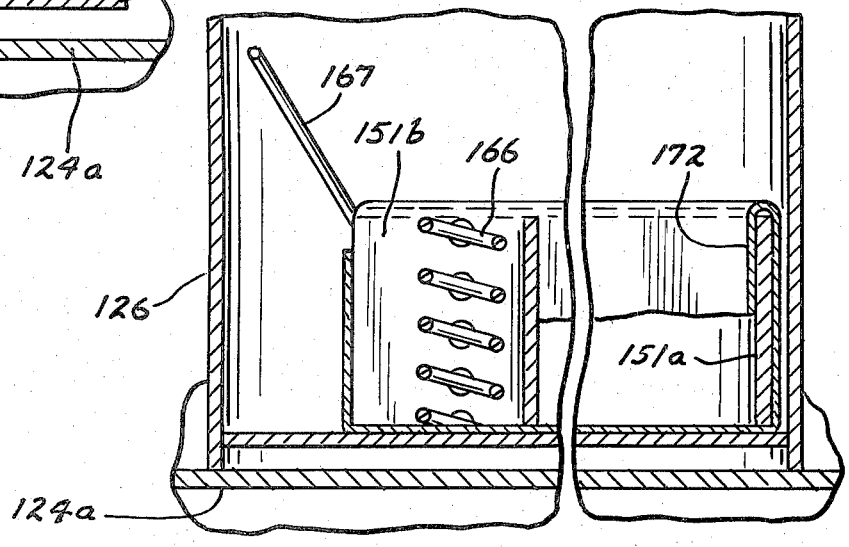

741
741
555

WASTE OIL HEATER

An improved waste oil heater that includes a vaporizer pan having a mounting ring, a replaceable aluminum foil piece mounted on the ring to form the bottom of the pan and a member mounted on the ring to provide threads, a tool threadingly engageable with the threaded ring member for breaking the pan loose from the bottom wall of a burner pot and removing the ring with caked residue thereon for purposes of cleaning, the burner pot having a novel arrangement of apertures for flow of air into the pot, the solid state electronic control apparatus to control the feed of waste oil that automatically compensates for variations in viscosities and caloric values found in a variety of used oils and automatically discontinues the feed in the event the flame in the burner pot goes out.

A thermocouple in the exhaust gas stream in the heater or in the stack senses the exhaust gas temperature and the control circuit operates the motor of the pump to feed oil to the pan at a fast or slow rate as determined by a room thermostat and the sensed stack gas temperature. The feeding of oil by the pump is controlled by the thermostat which alters the effect of the thermocouple by requiring a higher thermocouple voltage to produce slow feeding when the thermostat calls for more heat to be produced.

BACKGROUND OF THE INVENTION

Oil flow controls, vaporizer pan and burner pot for waste oil heaters.

In burning waste oil problems have been encountered in controlling the feed rate of oil to the burner pot to maintain the temperature within the desired range. Merely controlling the level of oil in the vaporizer pan is not satisfactory on many occasions when various waste oils are used since the different batches of oil have different caloric values, vary in viscosity and have varying amounts of water in the oil, and changes in the amount of draft result in a change in the rate of burning. Further, wear in the oil feed pump results in a change of the rate of oil pumped.

Additionally in burning waste oil there is a build up of residue (unburnt materials) that collect in the bottom of the vaporizer pan. As a result the effective level of oil in the pan varies and thus unless the amount of build up or residue is taken into consideration, with conventional controls the control of level of oil in the pan does not result in the desired control of heating. Further, due to the build up of residue in the pan, the pan has to be cleaned relatively frequently. However, with conventional vaporizer pans the task of cleaning the pan has been relatively difficult, particularly in view of the tendency for the residue to relatively firmly adhere to the bottom of the pan.

Also with conventional waste oil heaters problems have been encountered in proper burning of waste oil which results in environmental problems.

In order to minimize and/or overcome problems such as the above, this invention has been made.

SUMMARY OF THE INVENTION

A waste oil heater having electronic controls for sensing the exhaust gas temperature and room temperature and controlling the rate of feed of oil to the vaporizer pan to maintain the room temperature within the desired range even though waste oils of varying properties are used, and to automatically discontinue the feed of oil in the event the flame goes out and/or the temperature within the burner pot falls below that which will support combustion.

In order to facilitate cleaning of residue (unburnt solid materials) the heater is provided with a vaporizer pan that includes a mounting ring and replaceable metal foil on the ring to form a pan bottom. Preferably the pan is provided with a tool receiving member and a tool to coact therewith for breaking the ring free from the burner pot and remove the pan for cleaning.

To obtain proper combustion a described hole pattern is provided in the burner pot that includes circumferentially spaced holes above the diffuser ring in the burner pot and below the diffuser ring.

One of the objects of this invention is to provide new and novel control means for controlling the rate of oil to an oil heater vaporizer pan. Another object of the invention is to provide new and novel control means for a waste oil heater that senses the exhaust gas temperature and feeds the proper amount of oil to the vaporizer pan even though oils of varying properties such as caloric value, viscosity and etc. are used. In furtherance of the above objects it is another object of this invention to include new and novel means in the controls for automatically discontinuing the feed of oil in the event the flame in the burner pot goes out and/or the temperature in the burner pot falls below a level to maintain combustion. Another object of the invention is to provide new and novel control means for controlling the rate of feed of oil in accordance with the desired room temperature usuage, permit resetting of the desired range and at the same time maintain a minimum rate of feed of oil to maintain combustion in the burner pot.

An object of this invention is to provide a new and novel vaporizer pan for an oil heater that is relatively easy to clean. A further object of this invention is to provide a new and novel vaporizer pan and tool to facilitate removal of the pan for cleaning.

BRIEF DESCRIPTION OF THE DRAWINGS

FIG. 1 is a perspective view of the waste oil heater of this invention;

FIG. 2 is a fragmentary vertical cross sectional view of the apparatus of FIG. 1 with transverse and vertical intermediate portions broken away and various parts being schematically shown;

FIG. 3 is a fragmentary view of a portion of the cylindrical wall of the burner pot laid out flat with vertical intermediate portions broken away;

FIG. 4 is a fragmentary transverse cross sectional view generally taken along the line and in the direction of the arrows 4—4 of FIG. 2 with parts of the diffuser ring being broken away to show the positioning of the vaporizer pan in the burner pot;

FIG. 5 is a fragmentary vertical cross sectional view generally taken along the line and in the direction of the arrows 5—5 of FIG. 4;

FIG. 6 is a fragmentary vertical cross sectional view showing the tool threaded into the vaporizer pan tool receptacle for removing the pan from the burner pot.

Figure 7:
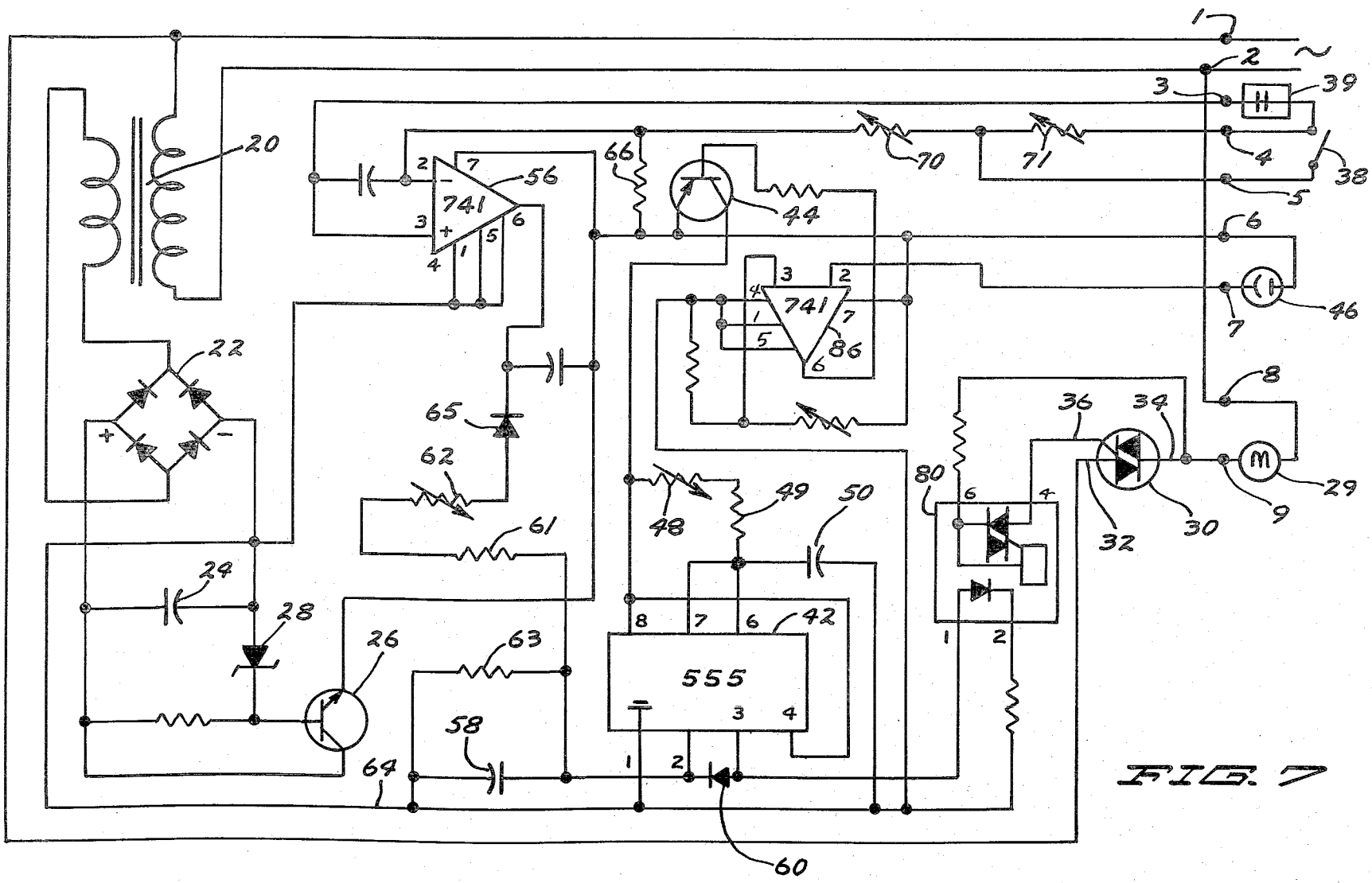
FIG. 7 is a schematic showing of various electrical controls and components of the apparatus of this invention.

Referring now in particular to FIGS. 1 and 2, the waste oil heater apparatus of this invention includes a metal cabinet B that has a base 111, a front wall 112, side walls 112, a rear wall 114, and a top wall 117 that are joined together to be of a generally rectangular box shaped configuration. One of the side walls is provided with an access opening which is closed by a door 115 hingedly mounted on the side wall while the top wall is provided with an access opening 118 that is closed by a closure (door) 119 which may be hingedly mounted to the top wall. On either side of the top wall access opening there are provided a plurality of vent slots 122 that open into the interior of the cabinet. Located within the cabinet is a cylindrical housing 124 that has a top wall 128 with an access opening, a lid 125 being provided for selectively closing the opening and permitting access into the interior (combustion chamber) 129 of the housing. An arcuate baffle (not shown) may be mounted in the cabinet to surround an upper circumferential portion of the housing in radial spaced relationship thereto.

Located within the housing 124 to abut against the bottom wall 124*a* thereof is a burner pot 126, a nonperforated annular member 127 extending radially from the upper edge of the burner pot to the intermediate portion of the housing for forming a plenum chamber 139. The circumferential wall 126*a* of the burner pot has a plurality of apertures 140–144 for permitting air flow from the plenum chamber 139 to the interior of the pot. Located in the burner pot is a vaporizer pan, generally designated 150, which includes a mounting ring 151. Axially intermediate the mounting ring and the top edge of the burner pot the cylindrical wall 126*a* of the pot has a radially inwardly extending annular rib 126*b* for mounting a diffuser ring, generally designated 155.

Each set of apertures 140–144 extend circumferentially around the cylindrical wall 126*a* with the apertures in each set being of substantially the same diameter, equally circumferentially spaced from one another and the same axial distance from the bottom wall 126*c* of the pot. Referring to an axial reference line 157 on the cylindrical wall, the center of each of the aperture 140 is circumferentially spaced from the center of the adjacent aperture 140 by a dimension L while the center of the adjacent aperture to the left of line 157 as shown in FIG. 3 is circumferentially spaced therefrom by dimension K. Likewise the center of each aperture 143 is spaced from the center of the adjacent aperture 143 by a dimension L while the center of the adjacent aperture to the left of line 157 is spaced therefrom by a dimension K. The center of each of the apertures 141 (also apertures 144) is circumferentially spaced from the centers of the adjacent aperture 141 (144) by a dimension L while the center of the adjacent aperture to the right of line 157 is spaced therefrom by a dimension N. The center of each of the apertures 142 is circumferentially spaced from the centers of the adjacent apertures 142 by a dimension R while the center of the adjacent aperture 142 to the right of line 157 is spaced therefrom by a dimension S.

The axial spacing of the centers of apertures 140 from the lower annular edge 126*d* of the cylindrical wall is a dimension E, the corresponding spacing of aperture 141 from said edge is E+F, the corresponding spacing of apertures 142 from said edge is E+F+G, the corresponding spacing of apertures 143 from said edge is E+F+G+H, and the corresponding spacing of apertures 144 from said edge E+F+G+H+J which equals dimensions D. As may be noted from FIG. 2 apertures 140 are located above the mounting ring 151, apertures 141 are axially between the diffuser ring and apertures 140, apertures 142 a substantial distance above the diffuser ring and apertures 143 axially between apertures 144, 142 with apertures 144 being above apertures 143.

The diffuser ring has a horizontal outer annular edge portion 157 with a plurality of equally circumferentially spaced apertures 158 opening therethrough, a frustoconical portion 159 having a major base peripheral edge integrally joined to the inner peripheral edge of portion 157 and a minor base peripheral edge integrally joined to the outer peripheral edge of the horizontal central portion 161. The central portion has a center aperture 162 while the frustoconical portion has a plurality of equally circumferentially spaced apertures 160. Preferably there are the same number of apertures 158 as apertures 160, the diameters of apertures 158, 160 being the same. The center of each aperture 160 is equally angularly spaced from the centers of the radially adjacent pair of apertures 158. It is preferred that the diffuser ring be used with its center portion axially more closely adjacent the vaporizer pan than the outer edge portion 157.

The mounting ring 151 includes a circular cylindrical portion 151*a* that extends angular through the major portion of a circle, for example about 330°, and a nearly right angle portion 151*b* having an apex edge more closely adjacent the center of portion 151*a* than the juncture of its legs to portion 151*a*. The outer diameter of portion 151*a* is significantly smaller than the inner diameter of the burner pot cylindrical wall 126*a*. Welded to the legs of the right angle portion 151*b* is a helical wound rod 166 to have a vertical helical axis and be located exterior of the mounting ring. A handle 167 that is about right angular in shape has its legs welded to the upper edge portion of the mounting ring adjacent the juncture of the legs of portion 151*b* to portion 151*a*. The apex 167*a* of the handle is located at a substantially higher elevation than the mounting ring and radially more remote from the center of portion 151*a* than any part of portion 151*a*. As may be noted from FIG. 4 when the part of cylindrical portion 151*a* opposite the handle apex 167*a* is closely adjacent the pot cylindrical wall 126*a*, the handle apex is significantly spaced from the most closely adjacent part of wall 126*a*.

To form the bottom of the vaporizer pan a piece of metal foil 172, preferable aluminum foil (not necessarily "heavy duty") sold for use in home kitchens, is extended across the bottom of the mounting ring, folded up along the exterior surface of the mounting ring, over the top edge of the mounting ring and then down the inside of the ring. The foil is not extended over the top of handle 167 or the coiled rod 166. It is noted the thickness of the foil is exaggerated in the drawings.

An oil feed member 170 is connected to the pump 29 and extends through a wall of the cylindrical housing and through the burner pot cylinder wall vertically between the rows of apertures 140, 141, the pump being connected to source (reservoir) of waste oil (not shown). The output end of the feed member extends a short distance, for example a couple of inches, into the interior of the burner pot to be in overhanging relationship to the vaporizer pan but not sufficiently far to prevent removal and replacement of the vaporizer pan as will be described hereinafter.

To apply air to the plenum chamber 139, a blower 185 may be provided in the cabinet that had an outlet opening to said chamber and an inlet opening (not shown) through the cabinet.

A combustion gas outlet 174 opens to the upper end of the combustion chamber 129 and to a heat exchanger 175 within the cabinet B so that the exhaust gases flow through the heat exchanger and thence through an outlet 176 to be vented to a chimney or directly to the outdoors. A circulation blower (not shown) is mounted in the cabinet exterior of the cylindrical housing to draw room air therein and discharge air under pressure to pass through tubes (not shown) in the heat exchanger, thence into the space between the cabinet and burner housing 124 and thereafter through vent slots 122 and vent apertures in door 115.

For placing the vaporizer pan in the burner pot and removing the mounting ring for cleaning there is provided a generally T-shaped tool T that includes an elongated rod 178 having a cross bar 179 welded to one end and a coiled rod or heavy wire 180 spirally wound on the opposite end portion of rod 178. The diameters of the unwound rods 166, 180 are about the same, the helical diameters of the wound rods are about the same, and the pitch of the helices are about the same. However the axial spacing of adjacent parts of the rods 166, 180 in a vertical plane is several times greater than the rod diameters. Thus the tool forms a loose threading fit with the tool receiving member 166 of the vaporizer plan.

In using the tool to place the vaporizer pan in the burner pot, closures 125, 119 are opened, the diffuser ring is removed and the tool threaded into the tool receiving socket provided by member 166. Now the pan is lowered in the pot with the side of the pan diametrically opposite the tool at a lower elevation than the part of the pan adjacent the tool so that the lower side can be moved past feed member 170, and a thermocouple, if provided to project into the pot, and then the pan is lowered so that the foil that forms the bottom of the pan abuts against the burner pot bottom wall 126*c*.

During use of the heater oil will be dispensed within the ring and on the foil. However the high temperatures in the pot during combustion will result in the foil becoming fragmented into many pieces with an oily substance going between the fragmentized pieces that formed the pan bottom and the pot bottom to form sort of a lubricant so that the residue resulting from combustion does not adhere to the burner pot bottom with anywhere near the tenacity that it would adhere to a conventional pan or burner pot metal bottom that did not fragmentize during use. The residue forms a cake across the bottom portion of the ring and more firmly adheres to the mounting ring than it does to the pot bottom.

When the residue is to be cleaned out of the heater, with the closures 119, 125 open and the diffuser ring removed, the tool is moved adjacent the tool receiving member and then rotated to thread tool coil 180 into the tool receiving member 166. As the tool is rotated and the lower end thereof abuts against the pot bottom wall, additional rotation of the tool in the same direction will result in the mounting ring and the built up cake residue breaking loose from the burner pot bottom wall. The cooperating tool and pan threads provide a mechanical advantage for breaking loose the mounting ring. After the ring is broken loose the tool is both moved upward (arrow 182) and pivoted (arrow 183) relative the adjacent cylinder wall 126*a* so that the pan is tilted to clear the feed member 170 and thence removed from the cabinet.

The caked residue may be removed from the ring, for example by hitting the ring a few times with a hammer, if necessary. It is to be noted that the caked residue is much more easily removed from the ring than from pans having non-foil conventional metal bottoms. After removal of the residue, a new piece of aluminum foil is applied to the ring in the manner previously described, the tool used to place the pan in the burner pot, and the tool unthreaded from the pan. The handle 167 facilitates handling the ring and also spacing the triangular part of the ring from the cylinder wall 124 so that the opposite side of the pan extends beneath the feed member 170.

After the pan is replaced a small amount of oil is manually poured into the pan and the oil in the vaporizer pan manually ignited by, for example, dropping a piece of burning paper in the pan. Assuming power is applied across pins 1 and 2, the photocell 46, if provided, senses the light from the flame whereby through the controls described below, oil will automatically be pumped into the vaporizer pan at a controlled rate. The photocell 46 may have its light receiving portion mounted by wall 124 or the burner pot in a position to receive light from a flame burning in the burner pot. In place of a photocell a thermocouple may be mounted by the burner pot for purposes of preventing the pump 29 pumping oil through feed member 170 in the event the temperature in the burner pot falls below a level necessary to support combustion in the vaporizer pan.

The control unit has input/output pins or terminals 1 to 9 and a power supply which comprises a step-down transformer 20, a full wave bridge circuit 22, a smoothing capacitor 24 and a voltage regulator transistor 26. The output voltage of transistor 26, which may be on the order of 8 volts, for example, is controlled by a zener diode 28.

The input winding of transformer 20 is connected to pins 1 and 2 to which an AC voltage supply source is connectable which may be the conventional 110 volts, for example.

Pin 9 is an output terminal to which a motor 29 of the fuel pump is connected. A TRIAC control element 30 having input and output terminals 32 and 34 and a control terminal 36 has the output thereof connected to the output pin 9 for driving the fuel pump motor. TRIAC input terminal 32 is connected to pin 1 which is connectable to the AC voltage source.

In accordance with the invention the fuel pump is driven with alternate on/off times as determined by a thermostat 38 connected to pins 4 and 5 and by stack temperatures sensed by a thermocouple 39 connected to pin 3 and 4 which is mounted to extend into the burnt oil exhaust gas stream in the stack or the heater.

Although different on/off times may be used within the scope of the invention, an arrangement is disclosed herein wherein the duty cycle or "on" time for the pump is an adjustable fixed value and the remainder or "off" time of the period is an adjustable variable value represented by a long or short period of time as determined jointly by the on/off status of the thermostat and the current stack temperature value sensed by the thermocouple 39 in the stack. By way of example, the "on" time may be a few tenths of a second while the "off" time may be two seconds for a fast feed condition and six seconds for a slow feed condition.

A 555 timer device 42 operated in a monostable multivibrator mode is utilized to obtain the desired duty cycle operation. Power is supplied to the Vcc pin 8 of the timer from the regulator transistor 26 through a transistor 44 which is normally on and which is controlled by a photocell 46, or a device with a similar function such as a thermocouple, connected to terminals 6 and 7. The function and operation of the photocell 46 will be referred to further on herein. The output of transistor 44, when on, is the effective supply voltage for the timer.

The "on/off" times of the timer are represented by the presence or absence of a voltage at the output pin 3 of the timer. The duty cycle or "on" time is determined in a known manner by (1) the resistors 48 and 49 between the output of transistor 44 and the threshold and discharge pins 6 and 7 of the timer and (2) the capacitor 50 between these pins and ground. By way of example, if the combined values of resistors 48 and 49 were 20K ohms and the value of the capacitor were 4.7 uF, the "on" time or duty cycle would be about 100 milliseconds.

The variable "off" times of the timer are controlled by the thermostat 38 and the thermocouple 39 acting through intermediate means to control the voltage on the trigger pin 2 of the timer. In operation when the timer output pin 3 is low, the output is brought to a high or "on" condition when the voltage at the trigger pin is lowered to one-third the supply voltage at timer pin 8.

As will be explained more in detail further on, the thermocouple 39 operates to generate a small DC voltage which varies in accordance with the stack temperature. This small voltage alters the current flow to the noninverting input 3 of an operational amplifier 56, which may be a 741 model, to control the output thereof.

It may be noted that the op amp 56 is wired as a comparator and is also wired so as to only use a single power supply with the power being supplied to pin 7 thereof and pin 4 being grounded. With the single power supply a larger signal at the inverting input 2 results in a positive output signal at pin 6 which is up to about half the supply voltage. A larger signal at the noninverting input 3 results in a positive output signal at pin 6 about equal to the supply voltage.

Connected to the trigger pin 2 of the timer is a capacitor 58 and means for discharging it at a slow or fast rate depending on whether the output of op amp 56 is high (equal to supply voltage) or low (equal to one-half or less of the supply voltage). A diode 60 between trigger and output pins 2 and 3 of the timer, poled in the direction of pin 2, functions to allow capacitor 58 to be charged by the timer output when the output is high but isolates the timer output from the capacitor when the output goes low as controlled by the RC circuit 48, 49, 50 described above.

After the timer output pin 3 goes low, this low condition is maintained until capacitor 58 discharges to one third the supply voltage of the timer at which point the timer trigger causes the timer output to again go high.

The discharge of capacitor 58 is controlled by and through resistors 61, 62 and 63. Capacitor 58 and resistor 63 are arranged in parallel and are connected to the ground line 64. Resistors 61 and 62 are between capacitor 58 and the output pin 6 of the op amp 56 and are connected thereto with a diode 65 poled in the direction of the op amp.

The slow or fast rate of discharge of capacitor 58 is determined by the output voltage of the op amp 56. If the op amp output voltage is high the route through diode 65 will be blocked and the entire discharge (slow) will be through resistor 63 to ground. If the op amp output voltage is less than the charge voltage on capacitor 58 the discharge route will be divided between resistor 63 on the one hand and resistors 61 and 62, diode 65 and the op amp pin 6 on the other hand. In the latter case the op amp output pin 6 acts as a current sink because its voltage is smaller than the voltage on capacitor 58.

In operation, when the timer output at pin 3 thereof goes low the capacitor 58 begins to discharge at a fast or slow rate which depends on whether the output voltage of op amp 56 is at its low or high value which in turn is dependent on the setting of the thermostat 38 and the effect of the stack temperature on the thermocouple 39.

With the arrangement disclosed it is seen that the longest and shortest discharge times for capacitor 58 are dependent on whether output of the op amp 56 is at its high or low value. The timing elements comprising capacitor 58, resistors 61 and 63 and the output of the op amp 56 may be selected, for example, so that such longest and shortest discharge times are six and two seconds respectively.

Referring to the thermocouple 39 in the stack or exhaust gas stream in the heater, it is in effect a small DC voltage source which varies in accordance with changes of temperature of the exhaust gas. Referring to the operation of thermocouple 39, it should first be noted how the supply voltage from transistor 26 is directed to the inputs 2 and 3 of the op amp 56 from the downstream end of a supply resistor 66. Resistor 66 is connected directly to the inverting input 2 of op amp and indirectly to the noninverting input 3 through resistors 70 and 71 and the thermocouple 39. Resistor 71 is shunted by a thermostat 38 located in the room that is to be heated.

With this type of circuit configuration there are bias currents supplied through resistor 66 to the inputs 2 and 3 of the op amp 56 which are only on the order of a few micoamps. A higher current input to the inverting pin 2 will cause a low positive voltage (up to about half the supply voltage) at the output 6 while a higher current input to the noninverting pin 3 will cause a higher positive voltage (up to about equal the supply voltage) at the output pin 6. The current to the input pin 3 will be less than, equal to or exceed the current to the input pin 2 depending on values of the resistances 70 and 71, the operating position of the thermostat 38 and the voltage generated by the thermocouple 39.

The closed position for thermostat 38 shunts resistor 71 and is the position which causes slow feeding of the burner, with a resulting minimum heat output, at a lower stack temperature than when in its open position. Resistor 70 is adjusted so that the resulting current to op amp pin 3 will exceed the current to op amp pin 2 to produce the slow feeding rate when the voltage generated by thermocouple 39 equals or exceeds a voltage which corresponds to a predetermined first stack (exhaust gas) temperature T1.

The open position for the thermostat 38 places resistor 70 and 71 in series with the thermocouple and the sum of the resistors 70 and 71 is adjusted so that the resulting current to op amp pin 3 will exceed the current to op amp pin 2 to produce the slow feeding rate when the voltage generated by the thermocouple 39 equals or exceeds a voltage which corresponds to a predetermined second stack (exhaust gas) temperature T2 which is higher than the predetermined first stack temperature T1 referred to above.

There are two primary operating ranges for the control circuit which operate in cooperation with thermostat 38 which is connectable to the terminals 4 and 5 and may be in a room supplied by a heater controlled by the control circuit hereof. As illustrated, thermostat 38 is in series with resistor 70 and operates to effectively place resistor 71 between terminal 4 and resistor 70 when the thermostat is open or to cause resistor 71 to be bypassed when the thermostat is closed.

The closing of thermostat 38 is an order for less heat and the resulting bypassing of resistor 71 as referred to above removes a resistance from the line and a higher range of currents are thus presented at the noninverting input 3 of the amplifier 56. Likewise, opening the thermostat serves to insert resistor 71 into the circuit and a lower range of currents are presented to the noninverting input of amplifier 56. Temperature variations to which the thermocouple 39 is subjected can vary the "off" time of the timer regardless of whether the thermostat is closed or open but the off times will be substantially longer when the thermostat is closed and thus not calling for heat.

Referring to the fuel feeding required for the two operating ranges, it is to be noted that each range is controlled primarily by stack (exhaust gas) temperatures. The opening of the thermostat causes maximum heat production until the thermostat is satisfied and the fast or slow feeding rate is determined by the maximum predetermined temperature T2 allowed for the stack. In operation the effect the thermocouple 39 has on the op amp 56 controls the discharge of capacitor 58 as described above. When the thermostat is closed only minimum heat production is desired and in this case the slow fuel feeding rate is determined by the minimum amount of fuel required to sustain burning in the pan. Resistor 71 is out of the circuit and resistor 70 has a value which will cause op amp 56 to be operated at the slow feed setting except when the stack temperature is below a minimum predetermined temperature T1 which causes fast feeding regardless of whether the thermostate is open or closed.

When the output of op amp 56 is high, resistor 63 permits a minimum rate of discharge for capacitor 58 so that there will be a maximum off time for the timer to insure a minimum amount of fuel fed to the pan during normal operation. As a further aid to understanding the invention it may be noted (1) that low and high outputs of the op amp 56 always corresponds respectively to fast and slow fuel feeding, and (2) the predetermined stack temperatures T1 and T2 are controlled by resistors 70 and 71.

The description thus far has described the control of the on/off times for the output pin 3 of the timer. As has been explained or at least implied, the "on" and "off" times of the timer are likewise the "on" and "off" times for the fuel pump and the TRIAC 30 is operated by the timer to control the fuel pump motor 29.

Between the timer 42 and the TRIAC 30 is an opto coupler 80 which is connected to the gate 36 of the TRIAC. Opto coupler 80 functions as a relay and internally thereof has an LED, a TRIAC driver substrate and a zero crossing circuit. When the timer output 3 is "on" the coupler 80 actuates the TRIAC gate 36 which allows AC current to flow from line terminal 1 through the TRIAC to the pump motor 29 through terminal 9. The other lead of the pump motor is connected through terminal 8 to line terminal 2 as shown.

Another feature of the control unit is that it shuts down automatically if the ignition sustaining flame in the pan goes out. This is required to prevent continued feeding and subsequent overflows of the pan which would occur if there were no flame to sustain combustion and consumption of oil in the pan.

The shutdown feature utilizes photocell 46 which is mounted in close proximity to the burner pot 126 to sense the absence or presence of a flame therein. Photocell 46 is connected between terminals 6 and 7 and operates through an op amp 86 to control the transistor 44 which in effect functions as a switch between the supply voltage source at the emitter of transistor 44 and the Vcc timer pin 8 at the collector of the transistor. The amplifier 86 may be a 741 model op amp and the photocell 46 is connected to the inverting input thereof.

Op amp 86 is wired similarly to op amp 56 such that when a signal at the inverting input 2 exceeds the signal at the noninverting input 3 the output voltage at pin 6 will be half or less than the supply voltage at pin 7. When the signal at pin 3 exceeds the signal at pin 2 the output at pin 6 will be close to the supply voltage.

The presence of a flame in the pan will cause the photocell, which acts as a variable resistor to transmit a larger signal to pin 2 than exists on pin 3 and this causes op amp 86 which turns on transistor 44 to permit the supply voltage to be established at the Vcc pin 8 of the timer because the resulting output voltage at pin 6 is low enough to cause transistor 44 to be turned on. Conversely, when the photocell does not sense a flame in the pan, the transistor will be off because the voltage at pin 6 will be high enough to turn it off and thus, with no supply voltage for the timer, the output of the timer will be zero and the fuel pump will not operate.

As the absence of a flame in the burner pot causes the timer 42 to be nonoperative, it will be understood that some form of starting procedure must be provided for initially feeding oil to the pan and igniting it while simultaneously turning on the timer 42.

The preferred approximate dimensions of the pot and diffuser ring are set forth hereinafter. The diameters of apertures 140 and 141 are 0.078 inches, apertures 142 are 0.125 inches, and apertures 143 and 144 are 0.109 inches, while the inside diameter of the pot (except at rib **126*b*) is 11.438 inches. Each of dimensions P and L is 0.500 inches, each of dimensions K and N is 0.25 inches, dimension R is 1.5 inches, dimension S is 0.375 inches, dimension E is 3.000 inches, dimension F is 1.250 inches, dimension G is 4.750 inches, dimension H is 1.187 inches, dimension J is 0.500 inches and dimension D is 10.687 inches. The axial height of the burner pot is 11.625 inches while the center of the rib is 7.00 inches from the lower annular edge of the pot. The diameter of the diffuser ring is 11.375 inches, the outer diameter of portion 159 is 8.125 inches and the inner diameter is 5.625 inches. The diameter of each of apertures 158, 160 is 1 inch and the diameter of aperture 162 is 3 inches. There are twelve each of apertures 158, 160. The difference in elevations between the top surface of ring portion 157 and ring portion 161** is 0.687 inches, while each of said portions is 0.250 inches thick.

What is claimed is:

1. Oil heater apparatus comprising means defining a combustion chamber, an oil vaporizer pan located in the combustion chamber and means for supplying oil to the pan, the pan including a mounting ring defining a vertical wall having a lower annular edge and metal foil positioned on the ring to form a pan bottom wall.

2. The apparatus of claim 1 further characterized in that the foil is of a material and a thickness that will fragmentize after combustion of oil.

3. The apparatus of claim 1 further characterized in that mounting ring includes an annular portion extending angularly through the major part of an arc of a circle and a tool receiving portion joined to the annular portion to extend angular through the remainder of an arc of the circle and that there is provided a tool for removing the mounting ring from the combustion chamber, the tool and pan having cooperating parts for removably connecting the tool to the pan.

4. The apparatus of claim 3 further characterized in that said cooperating parts include a tool threaded portion and a pan threaded portion for threadingly receiving the tool threaded portion.

5. The apparatus of claim 3 further characterized in that there is provided a handle that is joined to said annular portion adjacent the tool receiving portion.

6. Waste oil heater apparatus for heating a room comprising a burner pot, a pump unit having an electric motor for feeding oil to said pot, and an outlet for discharging a stream of exhaust gases resulting from burning oil that has been pumped into said pot, and control means for controlling the operation of the pump to control the rate of feed of oil to said pot, said control means including a thermocouple in the exhaust gas stream that provides a voltage that varies with the temperature in the exhaust gas stream, a thermostat in a room for sensing the room temperature and electric circuit means connected between the thermocouple, thermostat and pump to operate the pump for maintaining at least a minimum rate of feed of oil to maintain combustion in the pot and a greater rate of feed of oil than said minimum rate when the gas stream temperature at said thermocouple is below a predetermined minimum temperature and a greater rate of feed than said minimum rate when the temperature at the thermocouple is above said minimum temperature and the temperature at the thermostat is below a selected room temperature.

7. The apparatus according to claim 6 wherein the thermostat is operable by change of room temperature between "off" and "on", and said greater rate of feed is obtained when said gas stream temperature is below the first mentioned predetermined minimum temperatute, and when the thermostat is "on" and the gas stream temperature at said thermocouple is below a predetermined temperature that is higher than the first mentioned predetermined temperature.

8. The apparatus of claim 6 further characterized in that the electric circuit means includes means for permitting energization of the motor only when the oil is burning in the pot.

9. The apparatus of claim 6 further characterized in that there is provided a vaporizer pan in the pot for receiving oil fed into the pot, the pan including an annular mounting ring defining a pan sidewall and a piece of metal foil removably mounted on the mounting ring to define a pan bottom, said metal foil being fragmentizable by the heat generated by oil burning in the pot.

10. A waste oil heater assembly, comprising, a burner unit having a vaporizer pan and a pump unit including an electric motor for feeding oil to said pan, timer means having an output with alternate stable and unstable "off" and "on" output states connected to said motor, said timer means having an input for receiving an operating supply voltage, said timer means having a trigger input for triggering said timer means from a stable "off" state to an unstable "on" state at a trigger voltage which is less than a predetermined fraction of said supply voltage, diode means between said output and said trigger input poled in the direction of said trigger input, adjustable "on" time control means for setting said "on" time, dual range "off" time control means for lowering said trigger input voltage at the end of said "on" time at a first fast rate for fast feeding by said pump and a second slower rate for a slower standby feeding by said pump, temperature responsive voltage generating means adaptable for installation in a stack, comparator means having first and second signal comparing inputs for comparing signals and an output having a higher or lower output voltage depending on which of said signal comparing inputs is subjected to a larger signal, means supplying a reference signal to said first signal comparing input, a voltage source, said temperature responsive voltage generating means and first and second adjustable resistance means being disposed in series between said voltage source and said second signal comparing input, thermostat switch means for shunting one of said resistance means, said comparator means output being connected to said dual range "off" time control means to provide relatively long or short "off" times depending on the voltage level of said comparator means output.

11. A waste oil heater assembly, comprising, a heater unit having a vaporizer pan and a pump unit including an electric motor for feeding oil to said pan, timer means operable as a monostable multivibrator with stable and unstable states, said timer means having an input for receiving a supply voltage, said timer means having a trigger input for triggering said timer from a stable state to an unstable state at a trigger voltage which is less than a predetermined fraction of said supply voltage, said timer means having an output and means responsive to said output for operating said motor, RC means for said timer means determining the output "on" time of said unstable state, diode means between said output and said trigger input poled in the direction of said input, and "off" time control means for lowering said trigger input voltage at a selected predetermined rate at the end of said "on" time.

12. A waste oil heater assembly, comprising, a burner unit having a vaporizer pan and a pump unit including an electric motor for feeding oil to said pan, pump motor operating means having an output with alternate "off" and "on" output states connected to said motor, said pump motor operating means hava trigger input for controlling said output states thereof, dual range control means operatively connected to said trigger input to effect a first fast rate for fast feeding by said pump and a second slower rate for a slower standby feeding by said pump, said control means including temperature responsive voltage generating means adaptable for installation in a stack, said control means including comparator means having first and second signal comparing inputs for comparing signals and an output having a lower or higher output voltage to initiate said fast or slower rates depending on which of said signal comparing inputs is subjected to a larger signal, means applying a reference signal to said first signal comparing input, a voltage source, said temperature responsive voltage generating means and first and second adjustable resistance means being disposed in series between said voltage source and said second signal comparing input, said control means including thermostat switch means for shunting one of said resistance means to initiate said slower standby feeding for said pump.

13. A waste oil heater assembly, comprising, a burner unit having a vaporizer pan and a pump unit including an electric motor for feeding oil to said pan, pump motor operating means having an output with alternate "off" and "on" output states connected to said motor, said pump motor operating means having a trigger input for triggering it from an "off" state to an "on" state, dual range "off" time control means for triggering said pump motor operating means said "on" time at a first fast rate for fast feeding by said pump and at a second slower rate for a slower standby feeding by said pump, temperature responsive voltage generating means adaptable for installation in a stack, comparator means having first and second signal comparing inputs for comparing signals and an output having a higher or lower output voltage depending on which of said signal comparing inputs is subjected to a larger signal, means applying a reference signal to said first comparing input, a voltage source, said temperature responsive voltage generating means and first and second adjustable resistance means being disposed in series between said voltage source and said second signal comparing input, thermostat switch means for shunting one of said resistance means, said comparator means output being connected to said dual range "off" time control means to provide relatively long or short "off" times depending on the voltage level of said comparator means output.

14. Oil heater apparatus comprising a burner pot having a bottom wall, and an annular vertical wall having an upper annular edge and a lower annular edge, an annular housing having the burner pot therein, said annular housing being of dimensions to provide an annular clearance space between it and the burner pot and extending to a substantially higher elevation than the burner pot, an annular member extending between the burner pot top edge and a housing to in part define a plenum chamber therebeneath and between the housing and pot, a vaporizer pan in the burner pot, and a diffuser ring mounted by the burner pot vertically between its top and bottom edges, the pot annular wall having a first row of circumferential spaced apertures extending therearound at an elevation vertically between the diffuser ring and the vaporizer pan, a second row of circumferentially spaced apertures vertically between the first row of apertures and the diffuser pan, and a third, a fourth and a fifth row of circumferentially spaced apertures vertically between the diffuser ring and the annular wall top edge, the fourth row being vertically between the third and fifth row and the fifth row being vertically between the annular wall top edge and the fourth row, the apertures of the third row being of greater diameters and of greater spacing from the adjacent third apertures than the diameters of the other apertures and the spacing of the adjacent apertures in each of the first, second, fourth and fifth rows respectfully, the centers of the adjacent apertures of each of the second and fifth rows being of the same angular spacing, the centers of the adjacent apertures of each of the first and fourth rows being of the same angular spacing and being angular offset from the apertures of the second and fifth rows, the vaporizer having a top annular edge below the first row of apertures and comprising an annular mounting ring defining a pan side wall and a piece of metal foil removable placed on the mounting ring to define the pan bottom.

* * * * *